United States Patent [19]

Armour, II

[11] Patent Number: 5,008,987

[45] Date of Patent: Apr. 23, 1991

[54] MULTI-PURPOSE FASTENING DEVICE

[76] Inventor: Thomas W. Armour, II, 645 Isle View Dr., Akron, Ohio 44319

[21] Appl. No.: 464,300

[22] Filed: Jan. 12, 1990

[51] Int. Cl.[5] ..... A44B 18/00

[52] U.S. Cl. ..... 24/442; 24/306

[58] Field of Search ..... 24/442, 448, 449, 450, 24/452, 306, 31 V, DIG. 11, DIG. 29; 128/DIG. 15; 2/DIG. 6; 248/205.2

[56] References Cited

U.S. PATENT DOCUMENTS

| | | | |
|---|---|---|---|
| 1,638,073 | 8/1927 | Van Heusen | 24/442 |
| 3,307,872 | 3/1967 | Murcott | 24/306 |
| 3,383,738 | 5/1968 | Fox et al. | 24/306 |
| 3,461,511 | 8/1969 | Perina | 24/31 V |
| 3,947,927 | 4/1976 | Rosen et al. | 24/306 |
| 3,994,048 | 11/1976 | Rosenthal | 24/306 |
| 4,569,348 | 2/1986 | Hasslinger | 128/DIG. 15 |
| 4,671,787 | 6/1987 | Widman | 128/DIG. 15 |
| 4,719,876 | 1/1988 | Wilken | 128/DIG. 15 |
| 4,862,563 | 9/1989 | Flynn | 24/442 |
| 4,893,381 | 1/1990 | Frankel | 24/442 |

*Primary Examiner*—Victor N. Sakran

*Attorney, Agent, or Firm*—Oldham & Oldham Co.

[57] ABSTRACT

A multipurpose fastening device for securing items to more stationary objects or bundling elongated items or lengths or rope-like material together. More specifically, this device utilizes, primarily, lengths of webbing material together with strips of hook and loop fasteners in various embodiments. This multipurpose fastening device is reusable, durable, relatively inexpensive and easy to use.

2 Claims, 4 Drawing Sheets

FIG-5b
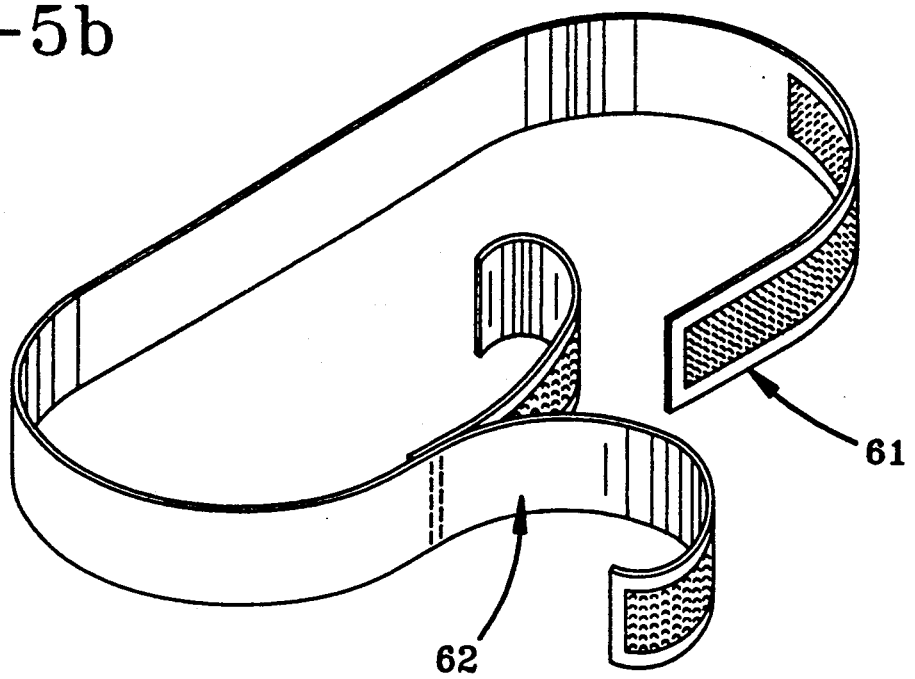
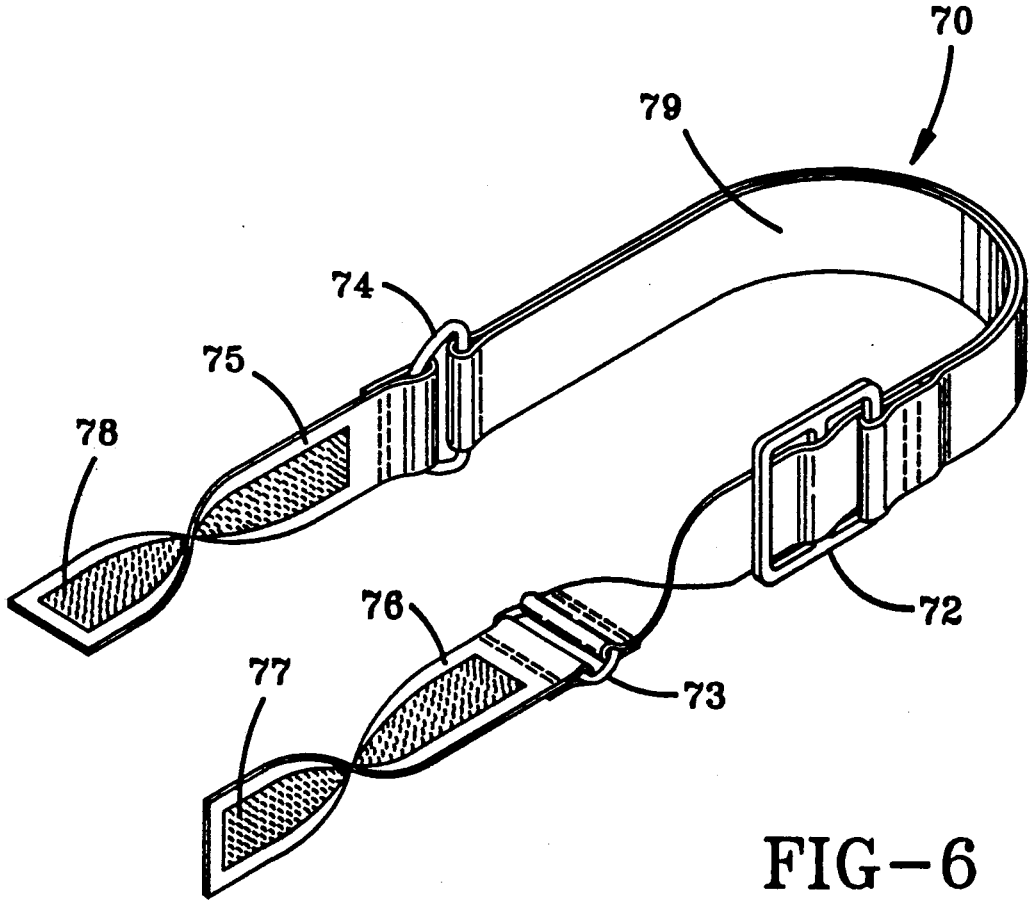
FIG-6

FIG-2C
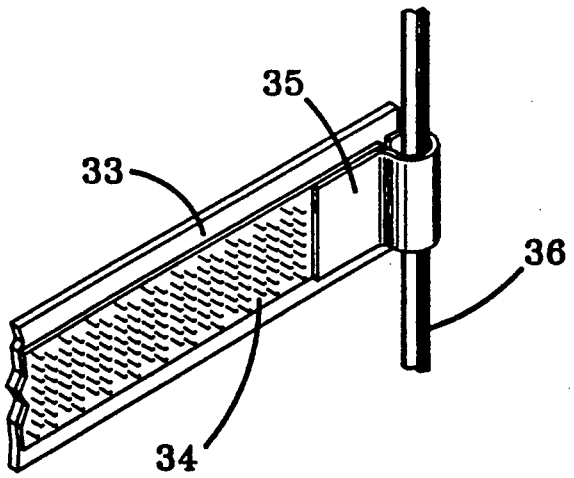
FIG-2D
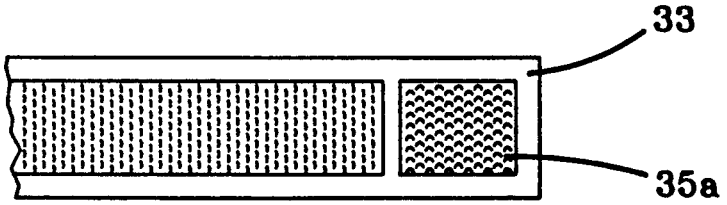
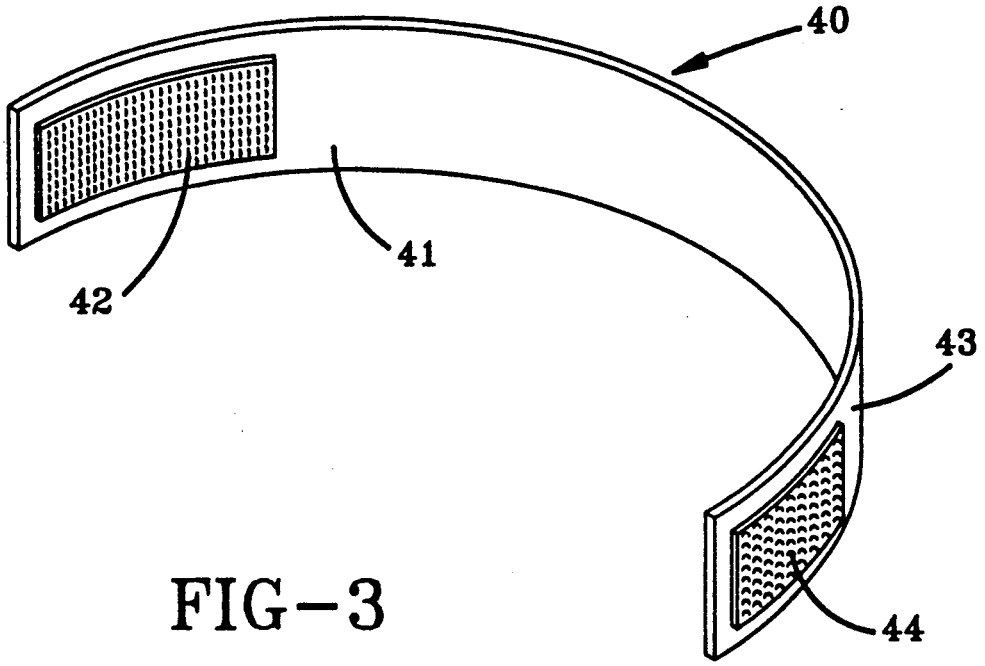
FIG-3

FIG-4
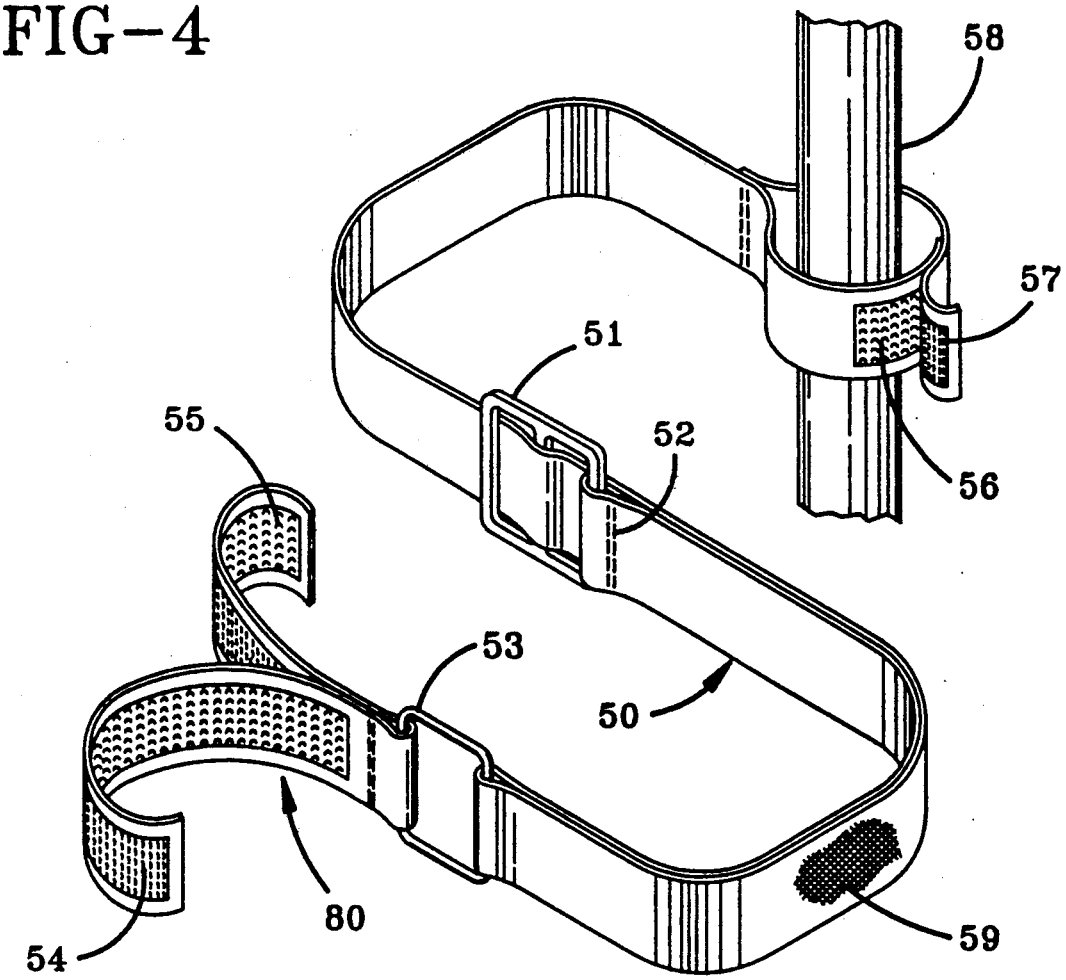
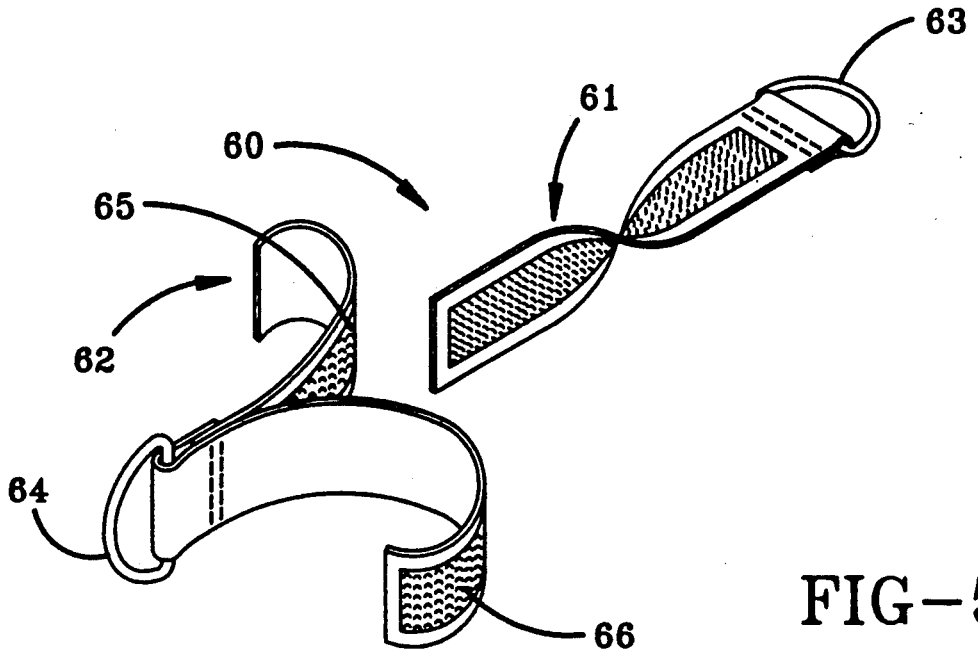
FIG-5a

MULTI-PURPOSE FASTENING DEVICE

TECHNICAL FIELD

The present invention generally relates to a multi-purpose fastening device. More specifically, this invention relates to a fastening device which combines webbing material and strips of hook and loop fasteners.

BACKGROUND OF THE INVENTION

There are endless ways in which people secure, fasten, or tie items to more stationary objects or bundle awkward or cumbersome items together. Conventionally such tasks were performed using any number of ropes, strings, twines, tapes and straps, all of which are well-known in the art.

Ropes, cords, twines and the like are very useful but have several disadvantages. Furthermore, the usefulness of these items is often dependent on the knot-tying abilities of the user. Poorly tied knots, or knots used under the wrong circumstances, may prove inadequate for their desired purpose. These same knots can be difficult and time-consuming to untie. Additionally, certain of these ropes, etc. may mildew, weaken or fray when exposed to the elements for long periods of time.

Assorted tape products may also be used for binding, securing, etc. but these also have disadvantages. The primary disadvantage is that tape products are normally designed for a single use. While tape products come in many different types and strengths, it is difficult to always have the correct product on hand. For some tasks, tapes are difficult to use and may adhere to themselves or to unwanted surfaces. Removal of these tapes often produces undesirable results. Adhesive may separate from the carrier strip of the tape and remain on the items to be secured or the adhesive may remove paint or other finishes, etc. when the tape is removed.

Many types of Wire products are available for securing, bundling, etc. However, such items break with repeated use, can cause damage by tearing or puncturing the product and can rust when exposed to moisture for an extended period of time.

A Wide variety of straps utilizing buckles, snaps and the like are well known in the art. These snaps and buckles are normally made from some type of metal and, therefore, susceptible to rust or breaking. This type of strap may tear, scratch, or otherwise damage the product to be secured. Additionally, many of these straps have little or no ability to adjust in size.

Ropes, adhesive tapes and the like are affected by certain weather conditions. These weather conditions, especially cold and precipitation, make it more difficult to work with these fasteners. Additionally, these tapes and related products may be less efficient and difficult, if not impossible, to apply during adverse weather.

Flexible cords with small hooks attached to each end are commonly used to secure items to more stationary objects. These cords, while useful for many tasks, do have several disadvantages not found in the present invention. These cords can pose a potential risk to the user if, while the cord is stretched, it is allowed to contract quickly, sending a hook into an unpredictable release. Furthermore, the hooks, often made of metal, may rust, tear, puncture, or otherwise damage the product to be secured.

Hook and loop fasteners are well-known in the art and commonly sold under the registered trademark "Velcro®". U.S. Pat. No. 4,671,509 to Newman is a tennis net center strap which uses Velcro® as a primary fastener. U.S. Pat. No. 4,700,432 to Fennell is a bundling tie which uses Velcro® as a means for connecting one portion to another. This device also uses a tie which once secured to an elongated member to be bundled must be removed using a tool.

SUMMARY OF THE INVENTION

This invention relates to multi-purpose fastener devices which utilize principally a combination of webbing material and hook and loop fasteners in several different embodiments.

The different embodiments of the present invention generally comprise a length of webbing to which various lengths of coordinating hook and loop fasteners are attached. Additional embodiments incorporate hooks and buckles for other means of attachment or adjustment.

It is an object of the present invention to provide a multi-purpose fastening device which is relatively inexpensive to manufacture.

It is a further object of the present invention to provide a multi-purpose fastening device which is reusable.

It is a further object of the present invention to provide a multi-purpose fastening device which can be adjusted to fasten items of various size.

It is still a further object of the present invention to provide a multi-purpose fastening device which is durable and weather resistant.

It is still a further object of the present invention to provide a multi-purpose fastening device which has strong holding power, but is easy to fasten and unfasten.

It is still a further object of the present invention to provide a multi-purpose fastening device which will not damage the objects being fastened.

It is yet a further object of the present invention to provide a multi-purpose fastening device which is extremely safe to use.

These and other objects and advantages of the present invention will become more readily apparent from the more detailed description of the preferred embodiments taken in conjunction with the drawings. Such objects and advantages are achieved by a multipurpose fastening device comprising an elongated carrier strip having a first and second end and having first and second surfaces; a means for fastening said device to itself, further comprising a hook and loop fastener with a first and second component, said first component affixed to said first surface of said carrier strip and said second component affixed to second surface of said carrier strip, wherein said device is folded upon itself so that said first component lockably fastens to said second component.

BRIEF DESCRIPTION OF THE DRAWINGS

In order to better understand the present invention, reference is made to the accompanying drawings, wherein:

FIG. 3 is a perspective view of still another embodiment of a multipurpose fastening device.

FIG. 4 is a perspective view of yet another embodiment of a multipurpose fastening device.

FIG. 5*a* is a perspective view of another embodiment of a two piece multipurpose fastening device.

FIG. 6 is a perspective view for yet another embodiment of a multipurpose fastening device.

DETAILED DESCRIPTION

Figure 1A:
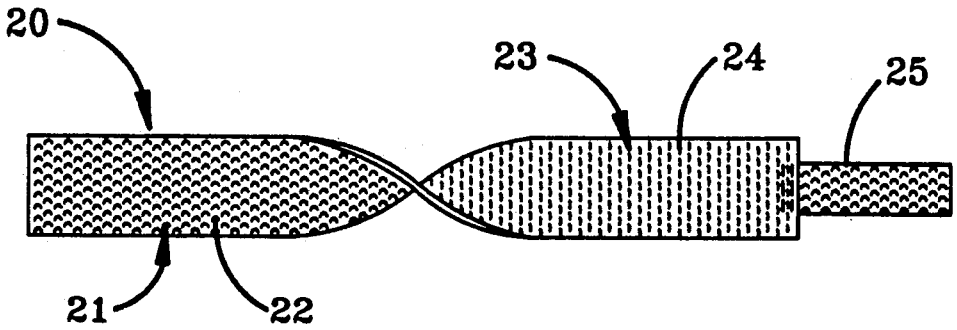
FIG. 1*a* is a plan view of one embodiment for a multipurpose fastening device which has been twisted about a midpoint for purposes of illustration.

Now, with reference to the invention illustrated in the drawings representing various embodiments, the invention generally discloses a multipurpose fastening device. A number of the embodiments utilize a webbing material. This webbing material is preferably made out of either nylon or polypropylene although any material known in the art could be used. Such material is Well-known in the art and available from a variety of manufacturers. The most convenient widths for use in the various embodiments of the present invention are 1½ and 3 inches, although any desirable width is contemplated. This webbing material is desirable because it is durable, aesthetically appealing and relatively weatherproof.

Each embodiment of the present invention utilizes a hook and loop fastening system. Hook and loop fasteners are well-known in the art and commonly sold under the registered trademark, "VELCRO®" which is manufactured by Velcro, Inc., Manchester, N.H.

FIG. 1*a* shows an elongated fastening strip 20 of varying length and comprising a length of loop surface 22 on the first side 21 of said fastening strip 20 and a hook surface 24 on the second side 23. These two surfaces, 22 and 24, are generally of equal length, placed back to back and permanently attached to one another. These surfaces may be attached by conventional stitching or sewing, by the use of any adhesive commonly known in the art, or by any combination of these two methods.

Fastening device 20 was developed to provide a simple, fast, economical and reusable way to organize, bundle, fasten or secure lengths of rope, cord or the like. Additionally, this device 20 may be used to collectively secure or hold together a plurality of suitable articles. To facilitate this, the device 20 includes a retaining tab 25, which allows the device 20 to be secured to a length of rope or the like, or to one of a plurality of elongated articles desired to be bundled.

Figure 2:
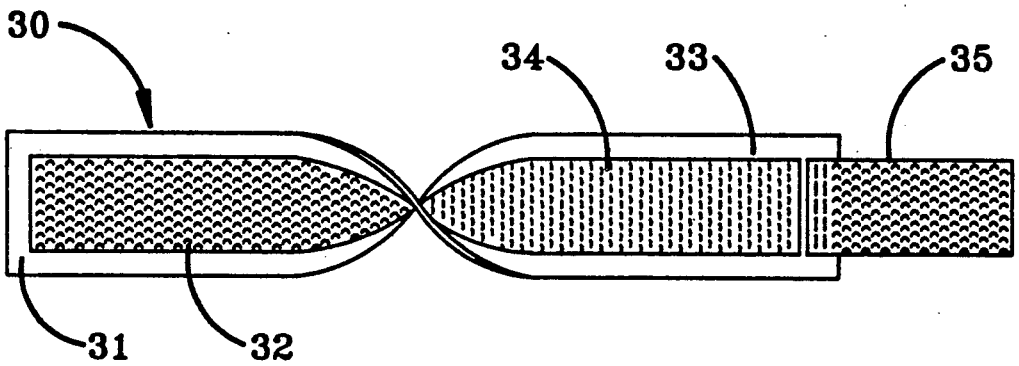
FIG. 2*a* is a plan view of one embodiment for a multipurpose fastening device which has been twisted about a midpoint for purposes of illustration.
FIG. 2*b* is a cross-sectional view taken along line 2—2 of the embodiment for a multipurpose fastening device of FIG. 2*a*.
FIG. 2*c* is a perspective view of the embodiment of a multipurpose fastening device illustrating the tab as employed to retain said device in contact with a specified object.
FIG. 2*d* is a plan view of a multipurpose fastening device wherein a portion of said device is removed for purposes of illustration. This embodiment shows an alternate positioning of the tab.

FIG. 2*a* is similar in principle and design to the embodiment illustrated in FIG. 1*a*. Fastening strip 30 of FIG. 2*a*, however, shows the layers of hook and loop, 34 and 32 as disposed onto a length of webbing material. Loop surface 32 is attached to first surface 31 of fastening strip 30 and hook surface 34 is attached to second surface 33 of fastening strip 30. The webbing serves as a carrier strip 30 which gives added strength to the invention.

Figure 1B:
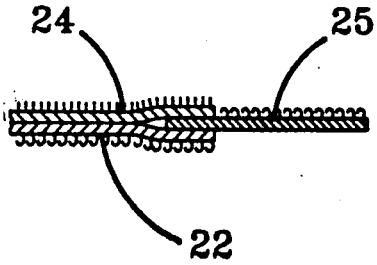
FIG. 1*b* is a cross-sectional view taken along line 1—1 of the embodiment for a multipurpose fastening device of FIG 1*a*.
Figure 2B:
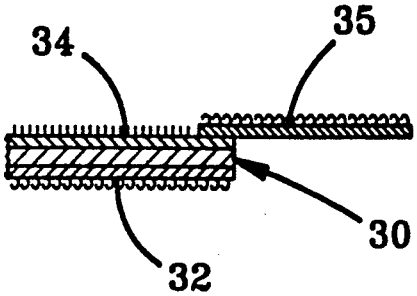

Similar to the embodiment of FIG. 1*a*, the strip 30 includes a retaining tab 35. These tabs 25 and 35 are strips of either hook or loop surfaces positioned at one end of the device. Tab 25 may be secured between the first and second surfaces 21 and 23 of device 20, as is illustrated by the cross-sectional view of FIG. 1*b*. Tab 35 may be affixed to the webbing material of device 30 as shown in FIG. 2*b*. The positioning of tabs 25 and 35 allow the tabs to be folded back and secured onto the strips 20 or 30 by means of the corresponding hook or loop surface on the strip. The tab of either embodiment 20 or 30 is useful when bundling lengths of rope or other suitable items. For example, in FIG. 2*c*, when used with a length of rope, a single hank 36 is placed at the end of device 30 having the tab 35. Tab 35 is folded back onto device 30 while encircling hank 36. Tab 35 lockably engages a surface of device 30 and retains hank 36 in place. The remaining length of rope or the like is gathered normally and device 30 may then be looped around the entire bundle of rope so that one surface of device 30 engages and secures to the other, thereby forming a loop which holds the lengths of rope together.

FIG. 2*d* shows a variation of the above embodiments where the retaining tab, shown as 35*a*, is incorporated directly onto the webbing material.

FIG. 3 shows device 40 having a first surface 41 and a second surface 43. This device again comprises a length of webbing material with a length of the hook fastening surface 42 affixed to first surface 41 and a length of the loop fastening surface 44 affixed to second surface 43. This embodiment, while similar to previous embodiments, shows the hook and loop surfaces as being located near the ends of device 40 and not being disposed on essentially the entire length of the device as shown in FIGS. 1*a* and 2*a*. Thus, the length of webbing material can vary over a broad range while enabling the ends thereof to be securely fastened together easily and conveniently.

This embodiment is again useful for fastening or securing objects together. One specific application of the present invention is its use in securing the sails of a sailboat to the boom. However, the length of webbing could vary to enable this embodiment to be used for other purposes.

This embodiment, in a shorter version, is also useful with the installation of soccer nets. These nets are normally installed onto the frame of the goal before each practice or match and taken down at the conclusion of same. The set up and removal with ordinary tape and string is time consuming and often frustrating. A plurality of devices such as the one illustrated in FIG. 3 are employed for this purpose. One end of the device 40 is wrapped around the frame post and a portion of the net. The two ends are then placed one on top of the other, and pressed together to engage the corresponding pieces of hook and loop. Removal is accomplished by merely grasping one end and pulling it away from the other. Such a closure system is reusable.

FIG. 4 discloses still another variation of the present invention. This embodiment shows a web of material, generally 59, of virtually any length. The web 59 may, if desired, be looped around and through buckle 51 to allow for adjusting the length of device 50. One end of device 50 has two flaps 56 and 57. Each flap is composed of the same web material as web 59 and one flap 56 is contemplated as an extension thereof. Second flap 57 is attached to web 59 at some distance from the end of flap 56 so that web 59 and flaps 56 and 57 coextensively form an essentially "Y" shape. The inner surface of flap 57 has a length of hook fastener attached thereon. The outer surface of flap 56 has a length of loop fastener attached thereon which lockably engages with the corresponding hook fastener on the inner surface of flap 57. These flaps 56 and 57, when not connected, allow an object 58 to pass between such flaps. The flaps 56 and 57 surrounding the object 58 are engaged, thereby securing the device to this object 58. Alternately, flaps 56 and 57 could have corresponding hook and loop fasteners on both sides of said flaps so that interchangeable fastening combinations are possible.

A second fastening unit 80 could be attached to web 59 using ring 53 as illustrated in FIG. 4. This variation shows two pieces of webbing material 54 and 55 connected at one end by any means known in the art. A metal, nylon, or hard plastic ring is passed through a loop formed in the webbing. In FIG. 4 lengths of like hook fasteners are placed on the inner surfaces of flaps 54 and 55. Lengths of like loop fasteners are placed on the outer surfaces of flaps 54 and 55. Thereby the outer surface of one flap 54 or 55 engages with the inner surface of the opposite flap 54 or 55 respectively, to lockably engage together.

A second fastener unit such as the one formed by flaps 56 and 57 could be placed directly on the second end of web 59. Devices of this type or the embodiment illustrated in FIG. 4 are useful when holding or securing cargo in places on car top carriers or in the beds of pickup trucks or the like. The buckle 51, shown in FIG. 4 allows for adjustments in order to make device 50 tight and secure.

The hook and loop fasteners are applied to this embodiment such that the inner surface of one flap possesses one type of hook or loop fastener and the outer surface of the opposite flap possesses the corresponding hook or loop fastener.

Additionally, this fastener device 80 is contemplated as functioning independent of the other portions of device 50. Device 80 can be connected to a web of material at ring 53 or to a rope or cord. One specific application contemplates the ring 53 as being attached to a length of rope. In this way, the device 80 could be used as a quick and easy means of attachment to a cleat or piling when docking a small boat.

FIG. 5*a* discloses another embodiment of the multipurpose fastening device which discloses a two part system 60. Component 62 is similar to fastening device 80 in FIG. 4. This device comprises two flaps 65 and 66. Like lengths of hook fasteners are attached to the inner surface of each flap 65 and 66. In this manner, flaps 65 and 66 will not lockably engage each other. Component 61 comprises a length of web material with a like length of loop fasteners disposed on each side of said component 61. A nylon, plastic or metal ring may be attached to the web material of component 61 by looping said web material through and onto itself where such is secured by means known in the art. A ring is attached in a similar manner to component 62.

This device is used for connecting two lengths of rope, cord or the like. One length of rope is coupled to component 61 and a second length of rope is coupled to component 62. Component 61 is inserted into the space between flap 65 and 66 wherein one surface of part 61 lockably engages the inner surface of flap 65 and a second surface engages the inner surface of flap 66.

Such a connection whereby both surfaces of a single web are connected to corresponding hook or loop surfaces, yields a substantially stronger fastening than can be achieved using only a single fastening combination of hook and loop. Generally, one fastener formed by one hook surface lockably connected with one loop surface, can withstand approximately 200 pounds of pressure. The fastener device 60, formed by two surfaces of hook and loop engaging one another, provides substantially more strength than a single fastener connection and may provide up to two times the strength.

FIG. 6 discloses still another embodiment of the present invention. Device 70 discloses a length of webbing material 79 which is looped around a ring 74 and through buckle 72 so as to achieve adjustable length. Rings 73 and 74 are made of metal, nylon or plastic and each define one end of device 70. One flap 75 or 76 is attached to each ring 73 or 74. Each flap 75 or 76 comprises a web material with lengths of hook or loop fasteners affixed to one or both sides of each flap 75 and 76. These hook and loop surfaces are arranged so that the outer surface of one flap lockably engages the inner surface of the opposing flap.

The hook and loop fasteners of the various embodiments are contemplated as being affixed to their respective surfaces in operable fashion, wherein a hook surface engages with a loop surface. It is not normally critical that a particular fastener surface be placed as illustrated at one position and not another, as long as corresponding pieces are used. The various rings are made of metal, plastic or nylon and shown as rectangular and "D" shaped although virtually any operable shape is contemplated. The webbing material while preferably nylon, polyester or polypropylene could be a cloth, canvas or any material possessing the desirable properties set forth above. The webbing material is contemplated as being of various lengths, widths and strengths.

While in accordance with the patent statutes the best mode and preferred embodiment of the invention has been described, it is to be understood that the invention is not limited thereto, but rather is to be measured by the scope and spirit of the appended claims.

What is claimed is:

1. A multi-purpose fastening device comprising:

a first and second elongated carrier strip, each strip having a first end and a second end and a first and a second surface;

said first end of each carrier strip defines an aperture through its width and each strip further comprising a ring connected to said strip such that an arc of said ring passes through said aperture, a web of material having two ends, each end being connected to the first end of one of said elongated carrier strips using a connecting means; and a means for removably engaging said first elongated strip to said second elongated strip comprising at least a first hook and loop type engaging element affixed to at least one surface of said first carrier strip and at least a second hook and loop type engaging element affixed to at least one surface of said second carrier strip and opposing the surface of the first hook and loop type engaging element affixed to said first carrier strip so that said first and second strips lockably engage upon contact.

2. The multi-purpose fastening device as recited in claim 1 wherein said connecting means comprises a ring element, a portion of which passes through a channel formed at the first end of each elongated strip and at each end of the web of material so as to connect one end of the web material to an elongated carrier strip.

* * * * *